United States Patent [19]

Parker

[11] 4,358,495

[45] Nov. 9, 1982

[54] DRYWALL PATCH KIT

[76] Inventor: Robert F. Parker, Rte. 5, Box 350, Wilmington, N.C. 28401

[21] Appl. No.: 251,084

[22] Filed: Apr. 6, 1981

[51] Int. Cl.[3] ..... B32B 29/00

[52] U.S. Cl. ..... 428/66; 428/64; 428/78; 428/80; 428/191; 428/535; 428/913; 156/71; 156/94; 427/140; 52/514

[58] Field of Search ..... 428/63, 64, 66, 78, 428/79, 80, 913, 912, 535, 138, 172, 156, 192, 191, 189, 537; 427/140; 52/514, 417; 156/94, 71, 154

[56] References Cited

U.S. PATENT DOCUMENTS 3,874,505 4/1975 Mirarchi et al. ..... 428/63 X 4,122,222 10/1978 Parker ..... 428/63 X

*Primary Examiner*—George F. Lesmes

*Assistant Examiner*—Alexander S. Thomas

*Attorney, Agent, or Firm*—B. B. Olive

[57] ABSTRACT

A preformed laminate structure for repairing and patching damaged areas of drywalls is adapted to be cemented thereto and comprises a backing member made from thin sheet material and sufficiently large to cover the area to be repaired and a facing member cemented to the backing member and also made of thin sheet material of the same shape but of less size than the size of the backing member.

2 Claims, 4 Drawing Figures

DRYWALL PATCH KIT

DESCRIPTION

1. Technical Field

The invention relates to devices and methods for repair and patching damaged drywalls, sometimes referred to as Sheetrock walls.

2. Background Art

An extensive and useful background of prior art practices and devices for repairing and patching drywalls is given in applicant's prior U.S. Pat. No. 4,122,222. This patent teaches the practice of making up a preformed laminate structure for making drywall repairs. A tapered layer of rigidified plaster-like material is adhered to one side of a backing member. In one embodiment taught by the patent, the rigidified material is left exposed and in another embodiment is covered by a sheet of facing material. While this prefabricated patch construction is believed to have represented a significant advance in the art, experience has revealed certain practical disadvantages including the lack of flexibility when the patch is applied to an uneven surface. Also, the manufacturing procedure and cost have presented other disadvantages. Additionally, the average homeowner has not been provided with a complete kit for making repairs in a manner which the average homeowner is equipped to handle.

With the above background in mind, the present invention has as an object providing an improved prefabricated patch for making minor repairs in drywall construction and also has as an object providing a kit having all the necessary materials for making such repairs.

DISCLOSURE OF INVENTION

The invention provides an improved prefabricated patch for making minor repairs in drywall construction. Also, there is provided a kit with a container holding a range of sizes of the improved prefabricated patches, drywall joint compound, spreading tool, and a set of instructions. The patches are illustrated as being composed of pairs of circular-shaped pieces of drywall-type paper of different diameter with the smaller size diameter piece being centrally positioned and cemented on the larger diameter piece. In use, a patch appropriate to the size of the damaged area is selected, is cemented in place over the damaged area and then is covered by cement which is spread, smoothed and sanded by tools provided in the invention kit.

BEST MODE FOR CARRYING OUT THE INVENTION

Figure 1:
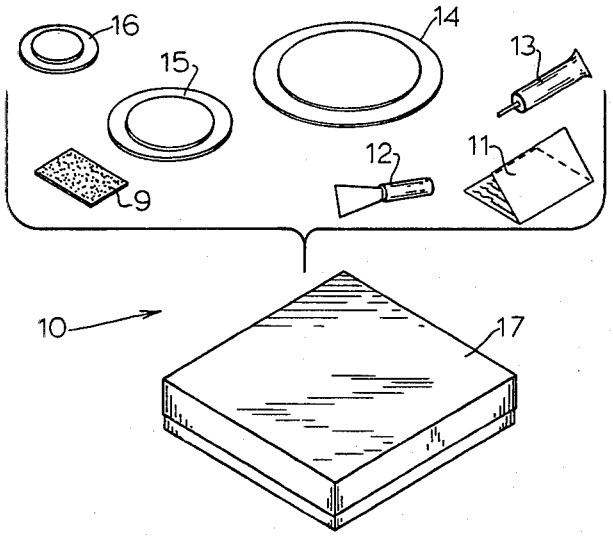
FIG. 1 is an exploded view of the elements constituting a drywall repair and patch kit according to the invention.

Reference is first made to FIG. 1 which illustrates the drywall patch and repair kit 10 of the invention. Kit 10 is designed with the do-it-yourself home repairman in mind and is composed of a supply of sandpaper 9, an instruction sheet 11, a putty knife or compound spreader 12, a tube of joint compound 13, several of the improved invention patches 14, 15 and 16 of various sizes and an appropriate container 17.

Patch 14, by way of example, is illustrated as being round in shape though, as will be better understood from later description, such patch could be rectangular, octagonal or of any other shape suited to the repair being made.

Figure 2:
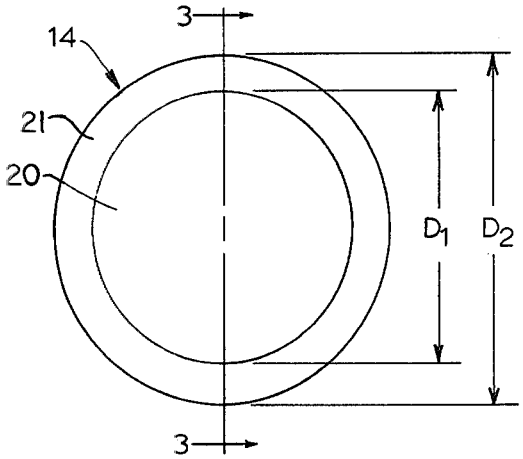
FIG. 2 is a plan view of one of the patches.
Figure 3:
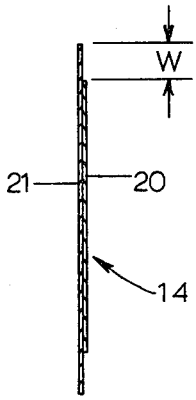
FIG. 3 is a sectional view of the FIG. 2 patch taken along line 3—3 of FIG. 2.

As best seen in FIGS. 2 and 3, the prefabricated drywall patch 14, used for illustration, is comprised of two circular-shaped layers 20, 21 of drywall paper cemented together. Drywall paper is the preferred material for use in making patch 14 since conventional drywall paper is known to be durable, strong, thin and is adapted to be made pliable on the job simply by dipping the paper in water. This characteristic enables patch 14 to be applied to the surface in a somewhat limber form so as to accommodate to any irregularities in the surface.

Figure 4:
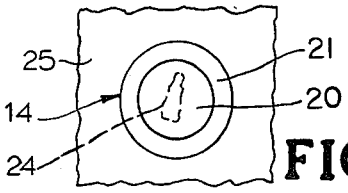
FIG. 4 is a somewhat schematic view illustrating how the invention patch is applied to a damaged area in a drywall with such area being indicated in dashed lines.

As illustrated in the drawings, it will be noted that diameter D1 of layer 20 is somewhat larger than the hole or damaged area 24, illustrated in FIG. 4, and diameter D2 of layer 21 is even larger. Such an arrangement gives single thickness material around the outer edge for blending in with the wall and double thickness and therefore a stronger area of reinforcement over the damaged area 24 being repaired.

In practice, joint compound from tube 13 is spread evenly by putty knife 12 over the area 24 to be covered and patch 14 is placed in position over the spread compound. As the compound dries, patch 14 will become firmly adhered to the surface 25 of the drywall on which patch 14 is mounted. After patch 14 is secured to the surface 25 of the drywall, a layer of joint or other plaster-like drywall compound material is spread around the perimeter of patch 14 and is tapered onto the drywall. Only one layer of such finishing material has been found to be required to give an acceptable finish whereas normal practice has required building up and finishing plural layers of the finishing compound.

After the finishing compound material dries, it is smoothed in the usual way, such as by using sandpaper 9 until the outer face portion of the patch blends smoothly into the surface 25 of the drywall. The patched area 24 including any exposed surface of the preformed patch 14 may then be painted to complete the operation. Even though the center of the finished patch will be raised slightly above the drywall surface by the thickness of the top layer 20, this has been found to be hardly noticeable after the job has been finished and painted.

Only a small amount of finishing compound is required to complete the patching operation. Thus, such compound can dry quickly. The finished patch 14 has been observed as providing a smooth, strong surface that will not easily crack even if it is struck. Normally, only a single sanding operation and final finishing operation is required which saves substantial time over prior art practices.

In one example of the invention, patches 14, 15, 16 were made of conventional thin, durable and strong drywall paper of the type used to cover the outside surfaces of conventional drywall board and which can be made pliable by dipping in water. Patch 14 had a diameter $D_1$ of about $12\frac{1}{2}$ inches, a diameter $D_2$ of $14\frac{1}{2}$ inches and a margin W of one inch. Patch 15 had the dimensions: $D_1$=eight inches; $D_2$=ten inches and W=one inch. Patch 16 had the dimensions: $D_1=3\frac{1}{2}$ inches; $D_2$=5 inches; and $W=\frac{3}{4}$ inch. In all cases, the layers 20, 21 were cemented together with joint compound and satisfactory results were achieved.

I claim:

1. A preformed laminate structure for patching and repairing damaged areas on previously installed drywalls, comprising:

(a) a backing member made from conventional, thin, drywall board cover paper material of uniform thickness adapted to be made pliable by dipping in water; and (b) a facing member also made from said conventional thin, drywall board cover paper material adapted to be made pliable by dipping in water and having the same shape but of less size than the size of said backing member and centrally positioned on said backing member with one side of said facing member being cemented directly to one side of said backing member so as to have a uniform margin formed by the thickness of said backing member between the respective outer edges of said backing and facing members and an even thickness of material corresponding to the sum of the thicknesses of said backing and facing members in the area where said members are cemented together thereby permitting the laminate structure to be made pliable by dipping in water prior to application.

2. A preformed laminate structure as claimed in claim 1 wherein said backing and facing members are circular in form with said facing member being of less diameter than the diameter of said backing member.

* * * * *